United States Patent [19]

Moran

[11] Patent Number: 5,040,704

[45] Date of Patent: Aug. 20, 1991

[54] METHOD AND APPARATUS FOR DISPENSING PRODUCT FROM A PRODUCT BAG

[75] Inventor: Michael J. Moran, Ontario, Canada

[73] Assignee: CCL Industries, Inc., Toronto, Canada

[21] Appl. No.: 512,167

[22] Filed: Apr. 20, 1990

Related U.S. Application Data

[63] Continuation-in-part of Ser. No. 470,911, Jan. 26, 1990.

[51] Int. Cl.[5] ..... B65D 83/00

[52] U.S. Cl. ..... 222/394; 222/386.5

[58] Field of Search ..... 222/80, 82, 94, 130, 222/386.5, 389, 394

[56] References Cited

U.S. PATENT DOCUMENTS

| | | | |
|---|---|---|---|
| 3,040,933 | 6/1962 | Everett . | |
| 3,178,075 | 4/1965 | Riedl et al. | 239/386.5 |
| 3,240,394 | 3/1966 | Modderno . | |
| 3,417,901 | 12/1968 | Sands . | |
| 3,541,581 | 11/1970 | Monson . | |
| 3,718,236 | 2/1973 | Reyner et al. . | |
| 3,944,064 | 3/1976 | Bashaw et al. . | |
| 4,039,103 | 8/1977 | Juillet . | |
| 4,049,158 | 9/1977 | Lo et al. . | |
| 4,095,724 | 6/1978 | Ferusco . | |
| 4,203,441 | 5/1980 | Theeuwes . | |
| 4,322,020 | 3/1982 | Stone . | |
| 4,340,155 | 7/1982 | Obrist . | |
| 4,373,341 | 2/1983 | Mahaffy et al. . | |
| 4,394,936 | 7/1983 | Shavit . | |
| 4,469,252 | 9/1984 | Obrist . | |
| 4,491,250 | 1/1985 | Liebermann . | |
| 4,543,279 | 9/1985 | Kai . | |
| 4,646,946 | 3/1987 | Reyner . | |
| 4,671,431 | 6/1987 | Obrist . | |
| 4,732,299 | 3/1988 | Hoyt . | |
| 4,785,972 | 11/1988 | LeFevre . | |
| 4,854,481 | 8/1989 | Bohl et al. . | |

FOREIGN PATENT DOCUMENTS

| | | |
|---|---|---|
| 0098476 | 6/1983 | European Pat. Off. . |
| 0105537 | 8/1983 | European Pat. Off. . |
| 0132511 | 4/1984 | European Pat. Off. . |
| 639913 | 12/1983 | Switzerland . |

*Primary Examiner*—Andres Kashnikow
*Assistant Examiner*—Lesley D. Morris
*Attorney, Agent, or Firm*—Kenyon & Kenyon

[57] ABSTRACT

A dispenser contains a productivity bag and a system for generating a dispensing pressure in a chamber created by the space between the product bag and the walls of the dispenser. The act of filling the product bag with product establishes an initial dispensing pressure. A pressure regulator in the chamber re-establishes the dispensing pressure after each spray down.

53 Claims, 4 Drawing Sheets

METHOD AND APPARATUS FOR DISPENSING PRODUCT FROM A PRODUCT BAG

RELATED APPLICATION

This application is a continuation-in-part of U.S. Ser. No. 470,911 filed on Jan. 26, 1990 entitled METHOD AND APPARATUS FOR MAINTAINING A PRESSURE WITHIN A PRODUCT DISPENSER.

BACKGROUND OF THE INVENTION

1. Field of the Invention

This invention is directed to a method and apparatus for dispensing product from a product containing bag. In particular, the present invention is directed to a unique method and apparatus in which a product containing bag and a pressure regulating system are disposed in a dispenser where the pressure regulating system is activated by the filling of product into the bag.

2. Related Art

In recent years various efforts have been exerted to supplant conventional aerosol-type dispensers, which use or used hydrocarbons such as isobutane, or fluorocarbons such as FREON refrigerant manufactured by DuPont, or other propellant means. Moreover, environmental concerns, including protection of the earth's ozone layer have placed limitations on usage of such conventional aerosol-type dispensers. These concerns and a variety of other considerations, including cost, wasted product and flammability, have prompted considerable research and development activity aimed at finding alternative means to dispense various flowable material products It is known to provide a product dispenser which uses a product containing bag disposed in a container and to provide a pressure generation mechanism in the container exterior to the bag to apply a pressure to the bag. A dispensing pressure is thus defined by the pressure generation mechanism.

It is also known to provide a pressure maintenance system within an enclosure or bag in which the dispensing pressure is produced. In these systems the product is exterior to the pressure generating bag.

Both of these systems have drawbacks. The product containing bag arrangements do not have controlled pressure regulation by which an initial dispensing pressure is substantially regenerated in the container upon dispensing of product unless liquefied gases are used. The pressure generating bags have drawbacks in the efficiency of product dispensing, i.e. the amount of product that is not dispensed because it is trapped in the container by the pressure generating bag. Both systems also have the drawback of requiring extra steps to activate the dispenser to provide an initial dispensing pressure. Additionally, there is a problem in setting the dispensing pressure at a desired initial pressure. Furthermore, in the pressure maintenance systems, while in gross terms the periodic release of a reactant into the second reactant maintains a pressure in the pressure generating bag, the dispensing pressure in that bag, if measured over time, shows a plurality of peaks and valleys. Thus, the pressure is not always regulated to a substantially constant pressure value during the dispensing process.

SUMMARY OF THE INVENTION

The present invention overcomes the shortcomings of prior dispensing systems which maintain a product under pressure via pressure generated in a pressure generating chamber. The present invention overcomes these shortcomings by utilizing an improved pressure regulating system which maintains a substantially constant pressure in the dispenser surrounding the product which is contained in a closed bag so that the last portion of the product is dispensed.

The present invention also provides a unique bag containing product or "product bag" configuration and method for utilizing such product bag to interact with the pressure regulating system as the dispensing container is filled.

In the present invention the relationship between the product bag and the pressure regulating system is such that the initial pressure for dispensing the product is set when the product bag is filled with product. Moreover, the initial pressure for a given container is determined by the amount of product fill.

The pressure regulating mechanism disposed in the container is not activated until the product is introduced into the product bag. Therefore, a closed dispenser including pressure regulating mechanism and product bag can be transmitted from a dedicated dispenser production assembly area and moved to a different filling location without harm to the pressure regulating system and without harm to the sterile characteristics of the product bag.

The present invention also provides a unique system for regenerating a pressure within a product dispenser. This system is less complex than those known in the prior art. Further, it provides a high degree of assurance that the pressure regenerated after product is dispensed from the container will be substantially equal to an initial or starting pressure of the product dispenser.

Furthermore, according to the present invention, this pressure regulating system can be configured so as to permit product dispensing with an unrestricted orientation of the product dispenser while avoiding loss in product dispensing pressure or interruption of product dispensing.

An apparatus for generating pressure and substantially controlling that pressure according to a first embodiment of the present invention includes a gas generating chamber having a first reactant disposed therein. The apparatus also includes an enclosure that is disposed within the gas generating chamber and which includes a walled structure having a permeable opening in at least one portion of the walled structure. The apparatus further includes a second reactant disposed in the enclosure and a first gas that is disposed in the enclosure where the second reactant is disposed between the first gas and the permeable opening. The first and second reactants are selected so that the product of their combination results in generation of a gas. In the apparatus of this embodiment the size of the permeable opening is such that at a pressure equilibrium (where pressure within the second enclosure approximately equals a pressure in the gas generating chamber surrounding the enclosure), the surface tension of the second reactant prevents a flow of the reactant through the permeable opening into the gas generating chamber surrounding the enclosure.

According to a method of the present invention, a pressure is controlled within a product dispensing container by disposing a first reactant in a hollow body that includes an aperture. The hollow body is disposed in the gas generating chamber as well. A start-up pressure is generated in the gas generating chamber where the start-up pressure is greater than an initial pressure in the hollow body, thereby causing a gas to enter the hollow body through the aperture until a pressure equilibrium has been established. At the equilibrium point, the pressure in the hollow body and in the gas generating chamber are substantially equal. The second reactant is forced out of or discharged from the hollow body when a pressure in the gas generating chamber falls below the equilibrium pressure. A compensating pressure is created in the gas generating chamber by a gas formed as a product of the reaction of the second reactant (forced from the hollow body) with the first reactant (disposed in the gas generating chamber.)

According to a further embodiment of the present invention, the system for regulating or controlling pressure in the gas generating chamber includes a first reactant and a pressure regulating mechanism that includes a tubular body which may be made of plastic and has a hollow portion. A second reactant and a gas are disposed within the hollow portion and check valves which permit flow in only one direction, are disposed at either end of the tubular body. One (first) check valve is arranged so that one end of the tubular body is capable of receiving gas when the pressure surrounding the tubular body exceeds the pressure of the gas within the hollow portion and the other (second) check valve is capable of releasing the second reactant into the gas generating chamber when a pressure within the hollow portion exceeds a pressure surrounding the tubular body. These two check valves are both one way valves. Thus, no gas or reactant escapes from the first check valve and no gas or liquid penetrate into the hollow portion through the second check valve.

According to a still further embodiment of the present invention, the system for regulating pressure includes a tubular body which may be made of plastic with a hollow portion and a solid stem portion. A liquid reactant and a gas are disposed in the hollow portion of the tube. One or more holes are provided in the hollow portion of the tube thereby providing a permeable access between the internal region of the tube and the area in which the tube is disposed. The size of the apertures and the type of the liquid reactant are selected so that a surface tension of the liquid reactant at the permeable holes will prevent a flow of liquid reactant into the region surrounding the tube when there is pressure equilibrium, i.e., when the pressure inside the tube is equal to the pressure outside of the tube. For example, when the reactant in the tube is a 50% solution of citric acid, an aperture of approximately 0.3 mm will give satisfactory results.

According to yet another embodiment of the invention, the hollow portion may include a separating means for assuring that, regardless of the orientation of the dispenser, the reactant disposed in the hollow portion is always between the permeable opening and the gas which is also enclosed in the hollow member. The separating means may include a diaphragm, a movable seal, preferably in the shape of a sphere, or barrier liquid such as a ferro-fluid.

According to yet another embodiment of the present invention the tubular body may be provided with one closed end and a second end covered with a bonded elastomeric film having one or more pierced openings through which liquid reactant and gas traverse to substantially maintain pressure equilibrium between the interior of the tubular body and the gas generating chamber.

DETAILED DESCRIPTION OF THE PREFERRED EMBODIMENT

Figure 1:
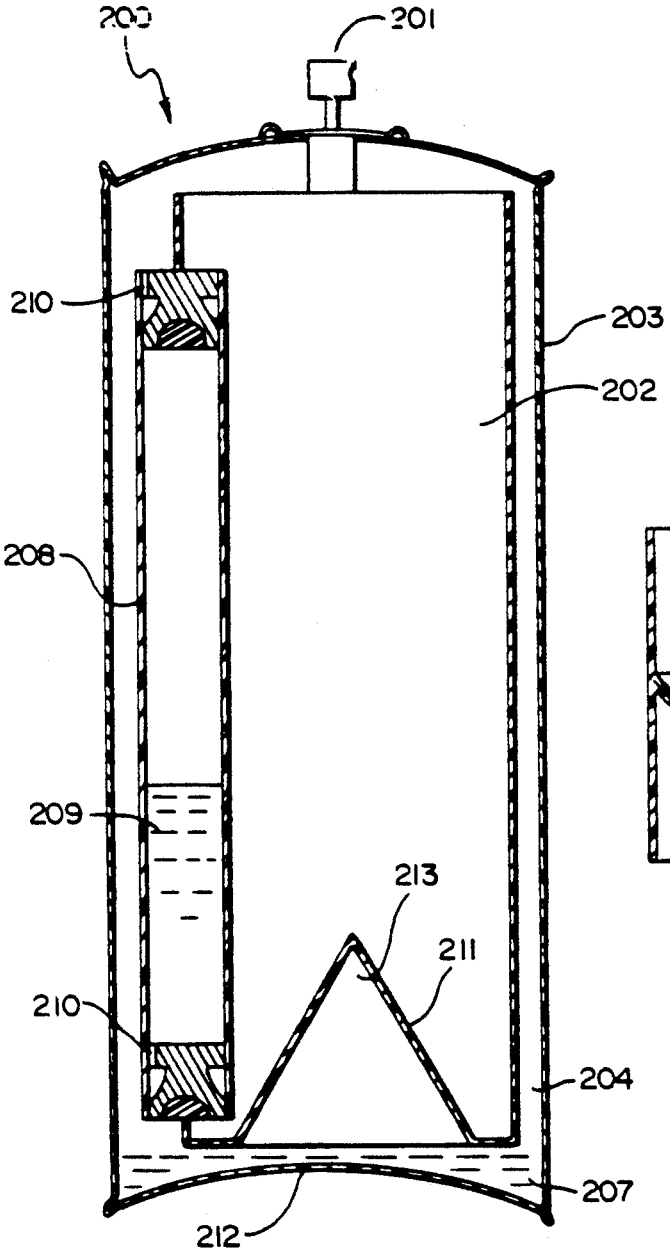
FIG. 1 illustrates a dispensing container system in accordance with an embodiment of the present invention.

FIG. 1 illustrates a dispensing system configuration in accordance with the present invention. A product bag 202 having a gusseted bottom is disposed within container walls 203. A gas generating chamber 204 is defined by the area bounded by the container walls 203 and the exterior of the product bag 202. A first reactant 207 such as sodium bicarbonate is disposed in a bottom of the container in the gas generating chamber 204 and a pressure regulating mechanism 208 is also disposed in the gas generating chamber. The pressure regulating mechanism 208 includes a second reactant 209 which can be a liquid reactant such as citric acid. In one embodiment the pressure regulating mechanism is a hollow tube having check valves 210 disposed at either end. When the second reactant 209 combines with the first reactant 207 gas is generated within the gas generating chamber 204. The pressure regulating mechanism system 208 is designed so that when a pressure outside of the tube exceeds a pressure inside of the tube gas enters into the tube until a pressure equilibrium is established. When a pressure inside of the tube exceeds a pressure outside of the tube the second liquid reactant 209 is forced from the tube into the gas generating chamber 204 so as to react with the first reactant 207 to thereby generate gas within the gas generating chamber and reestablish a pressure equilibrium between the pressure inside of the tube and the pressure surrounding the tube. The pressure generated in the gas generating chamber 204 places the product bag 202 under pressure and hence also places the product disposed within the bag 202 under pressure as well. Thus, when valve 201 is activated so as to dispense product, product is dispensed from the container under pressure produced in the gas generating chamber.

While preferably, sodium bicarbonate is used as the first reactant and citric acid in the second reactant, other reactants may be used. Also, solutions and slurry of the reactants may be used and the reactants may be interchanged if desired.

The pressure regulating mechanism system 208 will be described in greater detail below. However, the tube is designed in such a manner so as to react with the first reactant 207 to maintain a substantially constant dispensing pressure throughout the dispensing of the entire product disposed in the product bag.

The initial pressure of the dispensing system is set when the product bag is filled. As product is entered into the bag, the volume of the bag expands thereby reducing the volume of the gas generating chamber to in turn increase the pressure within that chamber. The increase in pressure of the chamber in turn results in an increase in the gas pressure within the pressure regulating mechanism 208. When the product bag has been filled with product, a specific pressure will have been set in the gas generating chamber 204 and a gas pressure will also have been set in the pressure regulating mechanism 208 as equilibrium is established between the pressure inside and the pressure outside of that mechanism. The initial pressure is determined in accordance with the amount of product fill in conjunction with a given can size. Then, whenever the pressure in the gas generating chamber drops due to the expulsion of product and the concomitant expansion of the volume of the gas generating chamber, the pressure regulating mechanism will expel some of the second liquid reactant 209 which will mix with the first reactant 207 and will regenerate pressure to re-establish the initially charged pressure within the gas generating chamber. Thus, the act of filling the product bag activates the pressure regulating system, charging it to a dispensing pressure. The pressure regulating system further controls the dispensing pressure over the course of dispensing the product from the container.

Figure 2:
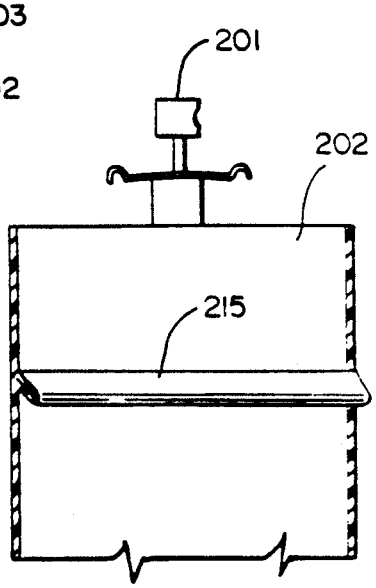
FIG. 2 illustrates a product bag to be utilized in a dispensing system in accordance with the present invention.

As shown in FIG. 1 and FIG. 2 the product bag has a gusseted end 211 and is a predetermined length dependant upon the container size. More specifically, product bag 202 is of a length such that the presence of product in the bag brings a base 213 of the gusset 211 into contact with the bottom 212 of the container 200 which may be dome shaped. The gusset serves to prevent undue force on a seal between the valve 201 and the bag when product is in the bag. Furthermore, the gusset improves bag fill capacity for a given can size. Preferably, the height of the gusset 211 (distance between the bottom of the bag and interior seam of the gusset) extends for approximately 1/2 of the diameter of the container.

As shown in FIG. 2 a fin seal 215 is preferably disposed along a side wall of the product bag. The placement of a fin seal away from the top or bottom of the bag allows more product to be placed in the bag for a given can size. Furthermore, by eliminating a fin seal at the bottom of the bag, the bottom can be made gusseted resulting in the advantages described above.

Figure 3B:
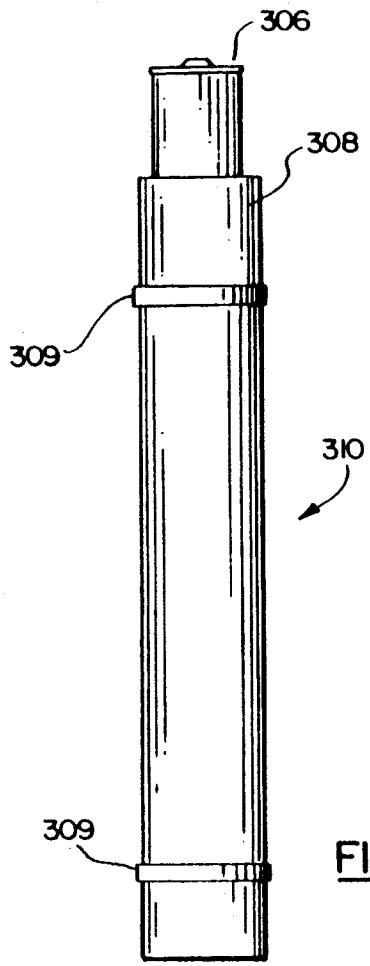
FIGS. 3A and 3B illustrate stages of producing an insert to be placed in a dispensing container so as to provide a dispensing system in accordance with the present invention.
Figure 3A:
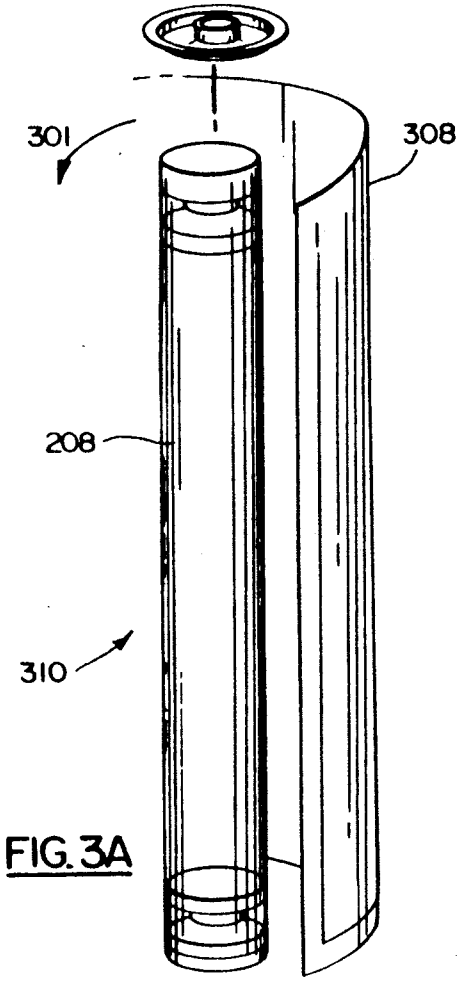

FIGS. 3A and 3B respectively illustrate a method for producing an insert for a dispensing container where the insert includes the pressure regulating mechanism. FIG. 3A illustrates product bag 308 and pressure regulating mechanism 208. The pressure regulating mechanism may be placed along one side edge of the product bag 308 and the bag may be rolled up in the direction 301 as shown so as to produce a tube-like structure which is initially constrained by means 309 (such as an adhesive band or dots) as shown in FIG. 3B. Thus the insert 310 is easily insertable into a dispenser container along a dispensing container assembly line.

A dispenser container may be brought along past an insertion station and the insert may then be placed into dispensers which can then be sealed. Subsequently, product is injected into the product bag 308 through the valve 306. Placing product in the bag 308 through valve 306 in the filling operation releases the constraining means 309 so that the bag expands to receive more product. As described above, the filling of the bag results in activation of the pressure maintenance system.

Figure 9:
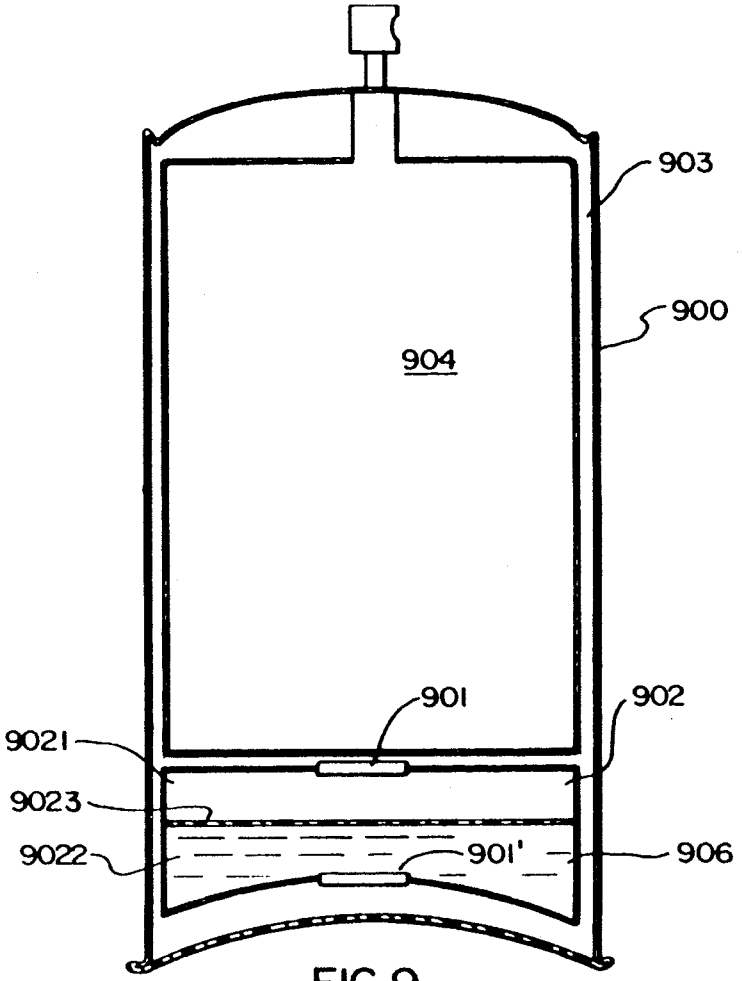
FIG. 9 illustrates another dispensing container system illustrating the pressure regulating mechanism disposed at the bottom of the container.

In constructing the insert, the pressure regulating mechanism is not limited to being disposed along a side edge of the product bag. The bag also need not be rolled around the mechanism. Instead, the mechanism might be attached to a portion of the bag which is then compressed into an accordion-like shape. Furthermore, it is possible to insert the bag and the pressure regulating mechanism into the dispenser separately, they need not be attached to one another. In such a circumstance the pressure regulating mechanism could be disk shaped and inserted into the bottom of the container prior to inserting the bag. Such a configuration is illustrated in FIG. 9 and described in greater detail below.

The fact that the pressure regulating system is not activated until product bag is filled permits a number of shipping options. First, a completed product dispenser, with product, can be shipped and in this form the dispensing pressure has already been determined. Another option is to ship a container with a pressure regulating system installed but without product. When product is later added, the dispensing pressure is then set. Another alternative is to ship the bag/pressure regulating mechanism, insert of FIGS. 3A and 3B. The insert can then later be placed into a container. As another alternative, the pressure regulating mechanism can be shipped separately.

The details of a number of embodiments of the pressure regulating mechanism will now be described with reference to FIGS. 4A to 8.

EXAMPLE 1

Figure 4A:
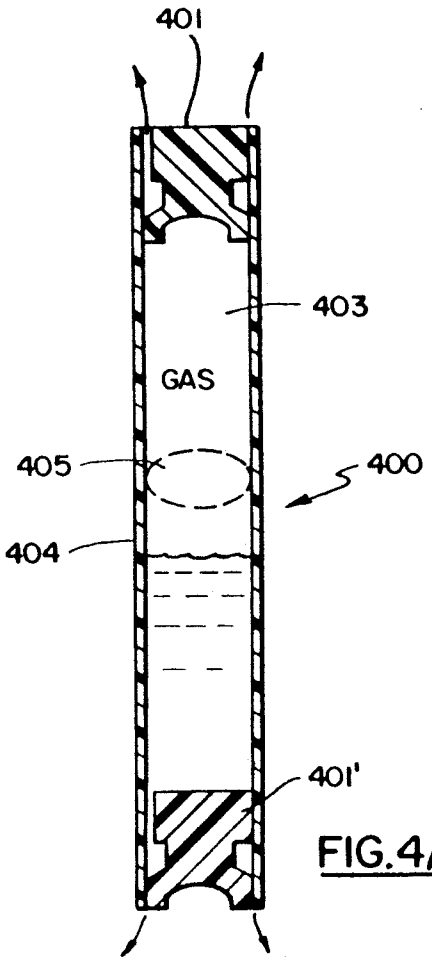
FIGS. 4A and 4B illustrate two arrangements of an embodiment of a tubular member having different valve configurations as a pressure regulating mechanism which can be inserted into a dispensing container to provide a dispensing system in accordance with the present invention.

FIG. 4A illustrates a first embodiment of the pressure regulating mechanism to be utilized in the dispensing system of the present invention. The pressure regulating mechanism 400 includes a hollow tube-like member 404 having check valves 401 and 401' (which are one way valves) disposed at the ends of the tube 404. Check valve 401 is oriented so that gas can enter into the hollow tube 404 along the side walls of that check valve and enter into the gas portion of the hollow tube chamber 403. This occurs as described above when the pressure outside of the pressure regulating mechanism 400 exceeds the pressure within the pressure regulating mechanism and continues until a pressure equilibrium state is established at which time there is no flow of gas into the pressure generating system 400.

The other check valve 401' is oriented in the hollow tube so that a liquid reactant 402 is released from the tube when the pressure inside of the tube 404 exceeds a pressure outside of the tube. However, no reactant or gas is able to enter into the tube through valve 401'. These two one-way valves, 401 and 401', together with the tube and reactants, which, in conjunction with the pressure generating chamber of the dispensing container define a pressure regulating system, comprise a true pressure feedback system. In particular, once the pressure regulating system is charged by the filling of the product bag which establishes an initial pressure in the gas generating chamber, the pressure regulating tube reaches its initial pressure state upon establishing a pressure equilibrium with the gas generating chamber. When product is dispensed the pressure in the gas generating chamber reduces due to the expansion of the volume and the pressure change results in the release of the liquid reactant 402 into the gas generating chamber so as to combine with the first reactant in the dispensing container. The two reactants combine to produce gas and the gas pressure in the gas generating chamber increases. With the proper metering of the amount of liquid reactant released from the tube, it is possible to control the gas generation in the gas generating chamber so as to reestablish the initial pressure of the pressure maintenance system. The control of gas generation is dependent on a number of factors such as the concentration of the two reactants and the check valve configuration which affects the durometer-hysteresis characteristics of the check valves. Thus, the gas generating chamber will resume the initial pressure and the product in the product bag is under substantially the same pressure after some product is dispensed as it was when originally filled. This operation continues until all of the product is dispensed from the bag.

The pressure regulating mechanism of the above-configuration can operate over a wide range of dispensing container orientations with respect to an upright position. However, the inclusion of a low friction, gas tight, movable seal 405 between the gas 403 and liquid 402 will permit the device to operate in any possible orientation without performance degradation.

Figure 4B:
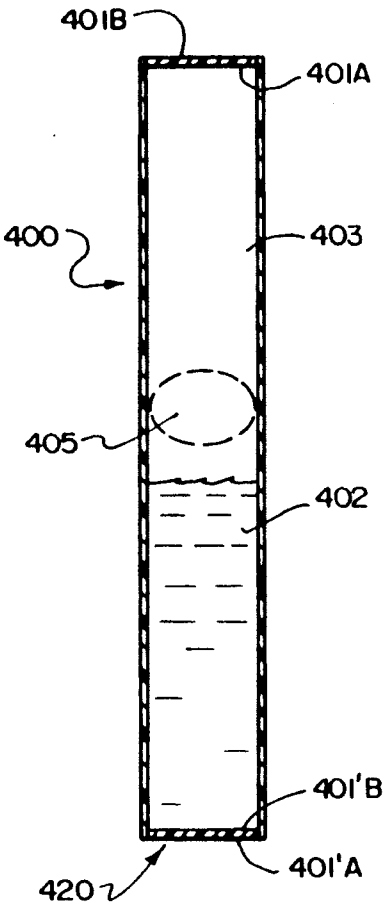

FIG. 4B illustrates another pressure regulating mechanism which utilize a different technology to achieve the same result as the check valves of FIG. 4A. In the arrangement of FIG. 4B, the check valves are replaced by thin film configurations. In particular, valve 401 is replaced by a first elastomeric film 401A disposed over a first end of the tube and a first semi-rigid film 401B disposed over the first elastomeric film. One or more holes are pierced through the first semi-rigid film and first elastomeric film. At rest the holes in the elastomeric film are closed by the elastic nature of the film and the pierced nature of the holes. At a second end of the tube replacing valve 401' are a semi-rigid film 401'B over the end and a second elastomeric film 401'A over the semi-rigid film. One or more holes are pierced through these latter two films with the same at rest state resulting.

The semi-rigid films define the direction in which the associated elastomeric film can move as the result of applied pressure. At the first end the first semi-rigid film allows the first elastomeric film to be responsive to a pressure differential in which a pressure in the gas generating chamber exceeds a pressure in the tube. Under this condition, the holes of the first semi-rigid and first elastomeric film are opened and gas passes into the tube until a pressure equilibrium is established. However, if a pressure inside of the tube exceeds that outside of the tube, the first semi-rigid film acts as a backing that prevents movements of the first elastomeric film thereby preventing the opening of the pierced holes in that elastomeric film. Thus, the configuration corresponds to check valve 401.

The second semi-rigid film and second elastomeric film use the same principles to perform the functions of valve 401'. In particular, when the pressure inside the tube is greater than that in the gas generating chamber, the second elastomeric film expands outwards, opening the pierced holes such that reactant 402 is discharged into the gas generating chamber. When pressure outside the tube exceeds that inside of the tube the second semi-rigid film prevents movement of the second elastomeric film thus preventing the opening of the pierced holes in that film.

In summary, the semi-rigid/elastomeric film configurations of FIG. 4B are analogous to the check valves 401 and 401' of FIG. 4A.

EXAMPLE 2

Figure 5:
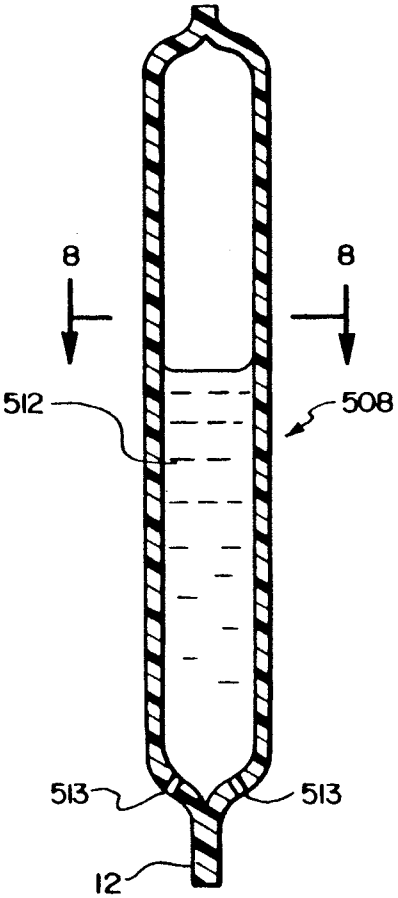
FIG. 5 depicts a side cross-sectional of a first arrangement of another embodiment of a tubular member in the apparatus of the invention.

FIG. 5 illustrates another embodiment of the pressure regulating mechanism 208 in the apparatus of the present invention. The embodiment includes a tube-like structure having a hollow portion 511 including one or more permeable openings or apertures 513. The number of openings is dependent upon the viscosity of a second reactant 512 disposed within the hollow portion 511 and typically will be between 1 to 4. A gas is also disposed in that portion of the mechanism 508. The second reactant 512 and the size of the apertures are selected so that at a pressure equilibrium where the pressure outside of the tube is equal to the pressure inside of the hollow portion of the tube, the liquid does not flow out of the tube regardless of its orientation with respect to the vertical plane. Stem portion 12 is provided so that the apertures 513 remain above a first reactant disposed in the gas generating chamber into which the pressure regulating mechanism 508 is inserted. Separating the aperture from the first reactant prevents the flow of liquids into the tube from the pressure generating chamber when such a pressure condition exists and only permits gas to flow into the tube when the pressure outside of the tube exceeds the pressure inside of the tube. The second reactant 512 and gas are selected so that the gas (as it permeates the aperture into the hollow portion) percolates through the second reactant and a pressure equilibrium is approached. The hollow portion of the tube may have an inside diameter of 7 to 12 millimeters. The walls of the tube may be composed of any economical non-reactive material such as, for example, polyethylene or polypropylene. One to four holes may be provided as the apertures or permeable openings, each hole having a diameter of approximately 0.3 millimeters for typical reactants. The second reactant 512 may be composed of a 50% solution of citric acid.

As described above the act of filling the product bag produces a starting pressure equilibrium in the product dispenser of 50 psig for example. When the product dispenser is activated so as to dispense product, a "spray down" to a reduced pressure, 45 psig for example, in the gas generating chamber will typically occur. At that point the gas inside of the hollow tube member is at a pressure of about 50 psig which exceeds the pressure in the gas generating chamber, about 45 psig. Therefore, in an effort to re-establish a pressure equilibrium, the gas in the tube applies its pressure to the second reactant 512 in the tube. The pressure differential overcomes the surface tension of the reactant with respect to the apertures or permeable openings 513. The second reactant 512 is metered into the first reactant in the gas generating chamber. Upon mixing of the two reactants gas is formed thus regenerating pressure in the gas generating chamber typically to between 48 and 52 psig when a new equilibrium is established in the hollow tube. Thus a dispensing pressure in the gas generating chamber is re-established. So long as enough liquid reactant is provided in the hollow tube member, this pressure regulating system will be capable of substantially re-establishing the initial dispensing pressure after every occurrence of dispensing, until all of the product is dispensed from the product pouch.

Figure 6:
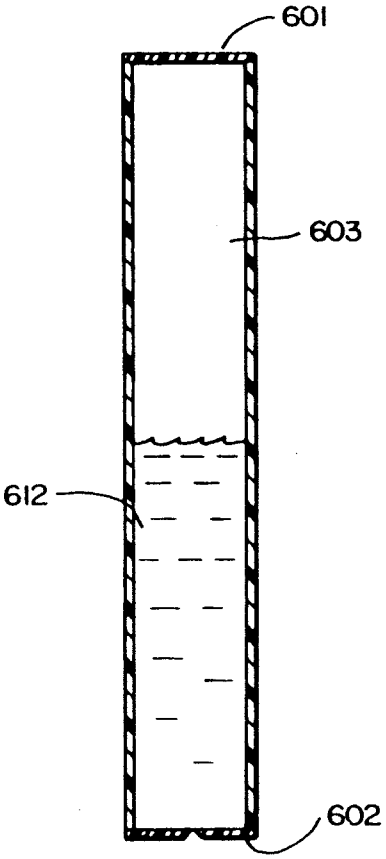
FIG. 6 depicts a side cross-sectional view of a second arrangement of the other embodiment of the tubular member in the apparatus of the invention.

FIG. 6 illustrates another arrangement of the embodiment of FIG. 5 where the apertures of the tube are replaced with thin film technology. In particular, a top end of the tube is sealed by a semi-rigid film 601. The seal can be heat sealed, ultrasonic welded or laser welded for example. But other seals are also usable. A bottom of the tube is covered by a bonded elastomeric film 602 with one or more pierced holes. The elastomer can be a rubber material like that used to make balloons. If a needle like device is used to pierce the material (as opposed to cutting or burning a hole) the hole will close up when the needle is removed. This embodiment will work in the same manner as the embodiment in FIG. 5, with the added benefit of being able to control to a greater degree the passage of liquid 612 or gas 603 through the opening. The hardness of the rubber, the thickness of the rubber and the size of the piercing needle are factors that control the amount of hysteresis that is built into the device. The effect is to require a certain pressure differential across the membrane before the membrane will stretch enough to pass liquid or gas. In the un-stretched condition the hole is closed. This approach makes the device less sensitive to shock and vibration and to temperature cycles.

The configurations of FIGS. 5 and 6 are workable from an orientation of 90° from the horizontal to approximately 5° from the horizontal. However, if the container is up-ended so as to turn it upside down during dispensing, then the gas of the tube will be in contact with the permeable opening and the liquid reactant will be disposed at an end of the tube removed from the apertures. In such a case, when the pressure inside the tube exceeds that outside the tube, as in spray down, the gas inside the tube will seep out of the permeable openings in an attempt to establish pressure equilibrium. No liquid reactant will be forced out of the tube. As a result, the device may not be capable of regenerating the initial or starting dispensing pressure.

EXAMPLE 3

In order to compensate for the possibility that the dispenser will be moved through various orientations during "spray down", the arrangements of FIGS. 4A, 4B, 7 and 8 illustrate modifications to the basic configuration which will prevent the gas from coming in direct contact with the permeable openings regardless of the orientation of the container.

In FIGS. 4A and 4B, a spherical plug is shown with a dashed line representation to indicate its optional nature. This plug is designed to fit tightly but movably along an inner circumference of the tube. Thus, the plug always maintains the second reactant oriented as to be in contact with the end of the tube that discharges that reactant i.e., the check valve 401' and pierced holes at end 420.

Figure 7:
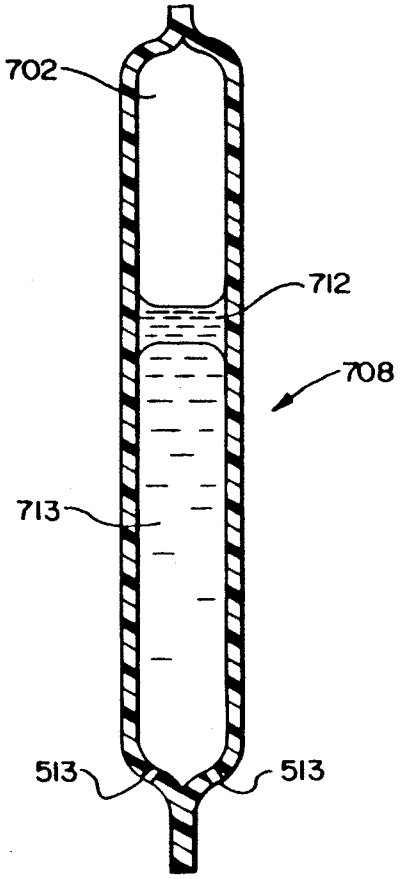
FIG. 7 depicts a side cross-sectional view of a third arrangement of the other embodiment of the tubular member in the apparatus of the present invention.

FIG. 7 provides another pressure regulating mechanism that includes means to dispense liquid at any orientation of the container. In this embodiment, an immiscible liquid with suitable surface tension or magnetic properties such as a ferro-fluid 712 is added to the top of the first liquid reactant 713. The result is that the second reactant is always kept at the same end of the tube regardless of the tube's orientation. Gas will then bubble upwardly through the reactant liquid and the immiscible liquid to join the gas bubble at the top of the liquid and establish a pressure equilibrium when the pressure in the gas generating chamber is larger than that in the hollow tube. The gas and the immiscible liquid will provide pressure to the second reactant to force that reactant through the apertures or permeable openings when the pressure in the tube exceeds that of the gas generating chamber, regardless of the orientation of the container and the orientation of the tube within the container.

Figure 8:
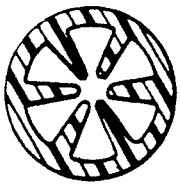
FIG. 8 depicts a cross sectional view of a geometric configuration usable with certain embodiments of a tubular member in the apparatus of the present invention.

FIG. 8 illustrates yet another configuration for modification to the system which can produce the same effect of allowing freedom of motion for the container. According to this embodiment, the tube is formed with the cross-section shown in FIG. 8 so as to maximize the effect of the surface tension of the second reactant By maximizing the surface tension of the second reactant, the cross sectional configuration tends to keep the reactant at one end of the tube. However, the configuration still permits the passage of small gas bubbles through the reactant and through the tube into the large gas bubble portion. As a result, the large gas bubble portion remains separated from the apertures or permeable openings by the second reactant regardless of the orientation of the container.

EXAMPLE 4

FIG. 9 illustrates another dispensing container configuration which includes another pressure regulating mechanism in accordance with the present invention. The container 900 includes a product bag 904 and a pressure regulating mechanism 902. Furthermore, the space 903 constitutes a gas generating chamber In this configuration the pressure regulating mechanism 902 is disposed at a bottom of the container and has a disk-like shape. The disk is divided into two chambers 9021 and 9022 separated by an elastomeric film diaphragm 9023. Check valves 901 and 901' operate in the same manner as check valves 401 and 401' described above. However, in this arrangement, the diaphragm 9023 replaces the spherical plug 405. In particular, when the pressure in chamber 9021 exceeds the pressure in the gas generating chamber the diaphragm exerts a force on the second reactant 906, thus discharging the reactant through valve 901 into the gas generating chamber. Then, as in the embodiments described above, the second reactant combines with the first reactant to produce gas and thus adjust the pressure in the gas generating chamber to approach a pressure equilibrium. Similarly, when the pressure in chamber 9021 is less than pressure in the gas generating chamber, gas is forced into that chamber via valve 901 to establish a pressure equilibrium. Thus, while the configuration differs from the configuration of FIGS. 4A and 4B due to the disk-like shape of the mechanism and the use of the diaphragm, the operation is similar to that of the mechanisms of those same drawing figures.

The present invention provides a unique configuration for dispensing product from a product bag and regenerating pressure within the product dispenser so that the initial dispensing pressure may be re-established. The configuration provides a simple and reliable structure for regulating the system pressure.

It should be understood by one of ordinary skill in the art that different solutions cf reactants can be utilized in the apparatus of the present invention. Furthermore, aperture size and hole size can be adjusted based on the surface tension or the viscosity of the reactant which is to be utilized in the pressure regulating mechanism. Furthermore, the size of the gas bubble and the size of the tube itself may be varied depending on its intended use in a product dispensing environment.

There are a number of advantages to the dispensing system of the present invention. The product in the bag configuration in the present invention provides improved evacuation in terms of a reduction in the amount of product left in the dispenser at the end of use. The present invention also provides advantages over known product in bag systems in that it can permit a can fill of about 70% or higher because it is the fill which determines the starting pressure in the dispensing system rather than a pressurized gas as in most product in bag systems. In most such systems (for example) the starting pressure must be as high as almost 170 psig in order to have a 50 psig final pressure. This is not necessary in the dispensing system of the present invention where the pressure regulating system eliminates the need for a high starting pressure.

When a lower starting pressure is realized, this allows use of a thinner can wall rather than those that are used in prior product in the bag systems.

The dispensing system of the present invention also provides the following advantages The system provides the capability of choosing a starting pressure depending upon the amount of product fill in the product bag together with a given can size and product bag size.

The dispensing system of the present invention may use off the shelf actuators or valves which are cheaper and less prone to clogging than special units designed for wide range of pressure in the dispensing of the product.

These and other benefits of the unique product in a bag dispensing system of the present invention will be apparent to those of ordinary skill in the art based on the description of the present invention provided in the specification and the associated drawings.

What is claimed is:

1. A product dispensing system comprising:
- a gas generating chamber;
- a first reactant disposed in said gas generating chamber;
- a first enclosure for storing the product, said first enclosure disposed within said gas generating chamber; and
- a second enclosure storing a second reactant, said second enclosure being disposed in said gas generating chamber and comprising,
  - a hollow member; and
  - a plurality of permeable areas responsive to a pressure differential existing between a pressure within said hollow member and a pressure in said gas generating chamber;
- wherein at least one of the permeable areas passes gas therethrough from the gas generating chamber to an internal chamber of said hollow member whenever a pressure in said gas generating chamber exceeds a pressure in said hollow member, and
- wherein at least one of the permeable areas passes said second reactant therethrough whenever said pressure in said tubular member exceeds said pressure in said gas generating chamber, said second reactant passes from said tubular member mixing with said first reactant and creating additional pressure in said gas generating chamber.

2. A product dispensing system, in which the product introduction activates a generation mechanism which comprises:
- a gas generating chamber;
- a bag for containing product having a valve connected thereto and being disposed in said gas generating chamber;
- a first reactant disposed in said gas generating chamber; and
- a pressure generation mechanism means containing a volume of gas and a second reactant having an initial pressure therein;
- said pressure generation mechanism means comprising,
  - a hollow enclosure;
  - a gas permeable opening;
  - an opening permeable by said second reactant; and wherein a pressure within said generation mechanism increases to a starting dispensing pressure upon filling of said bag with product via said valve and wherein said pressure generation mechanism discharges a quantity of said second reactant into said gas generating chamber when said pressure in said gas generating chamber falls below said starting dispensing pressure and said quantity of said second reactant discharged is proportional to a pressure differential between a pressure in said discharge means and a pressure in said gas generating chamber.

3. A method for producing a product dispenser for dispensing a product at a substantially constant pressure, comprising the steps of:
- inserting an empty bag for containing product into a container;
- inserting a first reactant into said container; inserting a dispensing pressure regulator into said container;
- sealing said container; and
- charging said dispensing pressure regulator to a starting dispensing pressure, said step of charging comprising the step of filling said bag with product.

4. The method of claim 3 further comprising the steps of:
- providing a second reactant in said pressure regulator; and
- providing a permeable opening for discharging a quantity of said second reactant into said container when a pressure in said container drops below said starting dispensing pressure and wherein said quantity of said second reactant is proportional to a difference between a pressure in said pressure regulator and a pressure in said container.

5. A pressure regulating mechanism for insertion into a gas generating chamber that includes a first reactant, the mechanism comprising:
- a hollow tubular member having a first and a second end;
- a second reactant disposed in said hollow tubular member;
- a gas disposed in said hollow tubular member; a charging mechanism for enabling an initial pressure in said hollow tubular member; and
- an outlet discharging said second reactant from said hollow tubular member when a pressure in said hollow tubular member exceeds a pressure outside said hollow tubular member.

6. The mechanism of claim 5 wherein said charging mechanism comprises a first one way valve disposed at said first end of said hollow tubular member and allowing gas to pass into said member only if a pressure outside said member exceeds a pressure inside said member.

7. The mechanism of claim 6 wherein said outlet comprises a second one-way valve disposed at said second end of said tubular member and allowing said second reactant to be discharged from said member only if a pressure inside of said member exceeds a pressure outside of said member.

8. A pressure regulating mechanism for insertion into a gas generating chamber that includes a first reactant, the mechanism comprising:

a hollow tubular member having a first and a second end;

a second reactant disposed in said hollow tubular member;

a gas disposed in said hollow tubular member;

a charging mechanism for enabling an initial pressure in said hollow tubular member;

an outlet discharging said second reactant from said hollow tubular member when a pressure in said hollow tubular member exceeds a pressure outside said hollow tubular member;

wherein said charging mechanism comprises a first one way valve disposed at said first end of said hollow tubular member and allowing gas to pass into said member only if a pressure outside said member exceeds a pressure inside said member; wherein said outlet comprises a second one-way valve disposed at said second end of said tubular member and allowing said second reactant to be discharged from said member only if a pressure inside of said member exceeds a pressure outside of said member; and wherein said first and second one way valves comprise elastomeric plugs arranged at said first and second ends of said hollow tubular member respectively.

9. A pressure regulating mechanism for insertion into a gas generating chamber that includes a first reactant, the mechanism comprising:

a hollow tubular member having a first and a second end;

a second reactant disposed in said hollow tubular member;

a gas disposed in said hollow tubular member;

a charging mechanism for enabling an initial pressure in said hollow tubular member;

an outlet discharging said second reactant from said hollow tubular member when a pressure in said hollow tubular member exceeds a pressure outside said hollow tubular member;

wherein said charging mechanism comprises a first one way valve disposed at said first end of said hollow tubular member and allowing gas to pass into said member only if a pressure outside said member exceeds a pressure inside said member; wherein said outlet comprises a second one-way valve disposed at said second end of said tubular member and allowing said second reactant to be discharged from said member only if a pressure inside of said member exceeds a pressure outside of said member; and wherein said first one-way valve comprises a plurality of films having a plurality of pierced holes where a first elastomeric film is disposed over said first end of said tube and a semi-rigid film is disposed over said first elastomeric film.

10. The mechanism of claim 9 wherein said second one way valve comprises a second plurality of films each having a second set of pierced holes where a second semi-rigid film is disposed over said second end of said member and a second elastomeric film is disposed over said second semi-rigid film.

11. A pressure regulating mechanism for insertion into a gas generating chamber that includes a first reactant, the mechanism comprising:

a hollow tubular member having a first and a second end;

a second reactant disposed in said hollow tubular member;

a gas disposed in said hollow tubular member;

a charging mechanism for enabling an initial pressure in said hollow tubular member;

an outlet discharging said second reactant from said hollow tubular member when a pressure in said hollow tubular member exceeds a pressure outside said hollow tubular member;

wherein said charging mechanism comprises a first one-way valve disposed at said first end of said hollow tubular member and allowing gas to pass into said member only if a pressure outside said member exceeds a pressure inside said member;

wherein said outlet comprises a second one-way valve disposed at said second end of said tubular member and allowing said second reactant to be discharged from said member only if a pressure inside of said member exceeds a pressure outside of said member; and wherein said second one-way valve comprises a plurality of films, each having a set of pierced holes where a first semi-rigid film is disposed over said second end of said member and a first elastomeric film is disposed over said first semirigid film.

12. The mechanism of claim 5 wherein said first end of said member is sealed impervious to gas and said second reactant and said charging mechanism and said outlet both comprise a plurality of apertures along said second end of said member.

13. The mechanism of claim 12 wherein said apertures are formed in a body constituting said member.

14. The mechanism of claim 12 wherein said apertures are formed as pierced holes in an elastomeric film over said second end of said member.

15. The mechanism of claim 5 further comprising means of maintaining said second reactant in contact with said second end of said member despite changes in orientation of said mechanism.

16. The mechanism of claim 15 wherein said means for maintaining comprises an immiscible liquid disposed between said second reactant and said gas.

17. The mechanism of claim 15 wherein said means for maintaining comprises a plurality of protrusions extending along an inner circumference of said member between said second reactant and said gas whereby a surface tension of said second reactant along said protrusions prevents said second reactant from interchanging positions in said member with said gas.

18. The mechanism of claim 15 wherein said means for maintaining comprises a spherical plug disposed in said member providing a movable seal between said gas and said second reactant.

19. A product dispensing system having a regulated dispensing pressure, comprising:

a container;

a first reactant disposed in said container;

a product bag disposed in said container, wherein a space between said product bag and a sidewall of said container defines a gas generating chamber; and a pressure regulating mechanism disposed in said gas generating chamber, said pressure regulating mechanism comprising, a hollow tubular member having a first end and a second end;

a second reactant disposed in said hollow tubular member;

a gas disposed in said hollow tubular member;

a charging mechanism enabling the establishment of an initial pressure in said hollow tubular member; and an outlet discharging said second reactant from said hollow tubular member when a pressure inside said hollow tubular member exceeds a pressure outside said hollow tubular member.

20. The system of claim 19 wherein said initial pressure in said hollow tubular member establishes an initial dispensing pressure for the system.

21. The system of claim 20 wherein said initial pressure in said hollow tubular member is established by an amount of product in said product bag.

22. The mechanism of claim 19 wherein said charging mechanism comprises a first one-way valve disposed at said first end of said hollow tubular member and allowing gas to pass into said member only if a pressure outside said member exceeds a pressure inside said member.

23. The mechanism of claim 22 wherein said outlet comprises a second one-way valve disposed at said second end of said tubular member and allowing said second reactant to be discharged from said member only if a pressure inside of said member exceeds a pressure outside of said member.

24. The system of claim 23 wherein said first and second one-way valves comprise elastomeric plugs arranged at said first and second ends of said hollow tubular member respectively.

25. The system of claim 23 wherein said initial pressure in said hollow tubular member establishes an initial dispensing pressure for the system.

26. The system of claim 25 wherein said initial pressure in said hollow tubular member is established by an amount of product in said product bag.

27. The system of claim 24 wherein said initial pressure in said hollow tubular member establishes an initial dispensing pressure for the system.

28. The system of claim 27 wherein said initial pressure in said hollow tubular member is established by an amount of product in said product bag.

29. The system of claim 19 wherein:

said charging mechanism comprises a first one-way valve disposed at said first end of said hollow tubular member and allowing gas to pass into said member only if a pressure outside said member exceeds a pressure inside said member, said first one-way valve comprising a plurality of films having a plurality of pierced holes, where a first elastomeric film is disposed over said first end of said tube and a first semi-rigid film is disposed over said first elastomeric film; and said outlet comprises a second one-way valve disposed at said first end of said hollow tubular member and allowing said second reactant to be discharged from said member only if a pressure inside of said member exceeds a pressure outside of said member, said second one-way valve comprising a second plurality of films, each having a second set of pierced holes, where a second semi-rigid film is disposed over said second end of said member and a second elastomeric film is disposed over said second semi-rigid film.

30. The system of claim 29 wherein said initial pressure in said hollow tubular member establishes an initial dispensing pressure for the system.

31. The system of claim 30 wherein said initial pressure in said hollow tubular member is established by an amount of product in said product bag.

32. The system of claim 19 wherein said first end of said hollow tubular member is sealed to be impervious to gas and said second reactant and said charging mechanism and said outlet both comprise a plurality of apertures disposed along said second end of said member.

33. The system of claim 32 wherein said initial pressure in said hollow tubular member establishes an initial dispensing pressure for the system.

34. The system of claim 33 wherein said initial pressure in said hollow tubular member is established by an amount of product in said product bag.

35. The mechanism of claim 32 wherein said apertures are formed in a body constituting said member.

36. The system of claim 35 wherein said initial pressure in said hollow tubular member establishes an initial dispensing pressure for the system.

37. The system of claim 36 wherein said initial pressure in said hollow tubular member is established by an amount of product in said product bag.

38. The mechanism of claim 32 wherein said apertures are formed as pierced holes in an elastomeric film over said second end of said member.

39. The system of claim 38 wherein said initial pressure in said hollow tubular member establishes an initial dispensing pressure for the system.

40. The system of claim 39 wherein said initial pressure in said hollow tubular member is established by an amount of product in said product bag.

41. A product dispensing system comprising:

a container having sidewalls and a bottom portion;

a first reactant disposed in said container;

a product bag, having a gusset at a first and thereof, wherein a seam of said gusset is in contact with said bottom of said container, said product bag also having a fin seal along a sidewall of said bag, disposed away from a top end of said container and from said bottom of said container;

a gas generating chamber defined in part by a space between said product bag and the sidewalls and bottom of said container; and a pressure regulating mechanism, disposed in said gas generating chamber and having a second reactant disposed therein, wherein said second reactant is metered out of said pressure regulating mechanism into said gas generating chamber in accordance with a pressure differential between a pressure inside of said mechanism and a pressure in said gas generating chamber.

42. The system of claim 41 wherein said pressure regulating system further comprises:

a hollow tubular member;

a charging mechanism enabling establishment of an initial pressure in said hollow tubular member; and an outlet discharging said second reactant from said hollow tubular member when a pressure inside said hollow tubular member exceeds a pressure in said gas generating chamber.

43. The system of claim 42 wherein said charging mechanism comprises a first one-way valve disposed at said first end of said hollow tubular member and allowing gas to pass into said member only if a pressure in said gas generating chamber exceeds a pressure inside said member.

44. The system of claim 43 wherein said outlet comprises a second one-way valve disposed at said second end of said member and metering said second reactant into said gas generating chamber if a pressure inside of said member exceeds a pressure in said gas generating chamber.

45. The system of claim 44 wherein said first and second one-way valves comprise elastomeric plugs arranged at said first and second ends of said hollow tubular member respectively.

46. The system of claim 44 wherein, said first one-way valve comprises a plurality of films having a plurality of pierced holes where a first elastomeric film is disposed over said first end of said tube and a first semi-rigid film is disposed over said first elastomeric film; and said second one-way valve comprises a plurality of films having a second set of pierced holes, where a second semi-rigid film is disposed over said second end of said member and a second elastomeric film is disposed over said second semi-rigid film.

47. The system of claim 42 wherein said first end of said member is sealed impervious to gas and said second reactant, and wherein said charging mechanism and said outlet both comprise a plurality of apertures along said second end of said member.

48. The mechanism of claim 47 wherein said apertures are formed in a body constituting said member.

49. The mechanism of claim 47 wherein said apertures are formed as pierced holes in an elastomeric film over said second end of said member.

50. A method for forming an insert for a pressure regulated dispensing container, comprising the steps of:

providing a product bag;

disposing a pressure regulating mechanism along a side edge of said product bag;

rolling said product bag in a first direction around said pressure regulating mechanism; and sealing said product bag in a rolled up state around said pressure regulating mechanism with said seal being responsive to pressure generated within said product bag to release and allow said product bag to unroll.

51. A method for assembling a pressure regulated dispensing system; comprising the steps of:

providing a container;

inserting a first reactant in said container;

inserting a special insert assembly into said container, said special insert assembly comprising, a pressure regulating mechanism;

a product bag rolled around said pressure regulating mechanism;

pressure responsive tags maintaining said product bag rolled around said pressure regulating mechanism; and a dispensing valve connected to said product bag; and sealing said container while allowing a portion of said dispensing valve to protrude outside of said container.

52. The method of claim 51 further comprising the steps of initializing a pressure in said pressure regulating mechanism and releasing said pressure responsive tags by introducing product into said product bag.

53. The method of claim 52 wherein said product is introduced into said product bag via said dispensing valve.

* * * * *